US011572710B2

(12) United States Patent
Liao

(10) Patent No.: US 11,572,710 B2
(45) Date of Patent: Feb. 7, 2023

(54) MECHANISM OF ELECTRIC LOCK FOR DOOR

(71) Applicant: Yi-Fan Liao, Taoyuan (TW)

(72) Inventor: Yi-Fan Liao, Taoyuan (TW)

( * ) Notice: Subject to any disclaimer, the term of this patent is extended or adjusted under 35 U.S.C. 154(b) by 107 days.

(21) Appl. No.: 17/034,453

(22) Filed: Sep. 28, 2020

(65) Prior Publication Data

US 2021/0102405 A1 Apr. 8, 2021

(30) Foreign Application Priority Data

Oct. 4, 2019 (TW) ..... 108213167

(51) Int. Cl.
*E05B 47/00* (2006.01)

(52) U.S. Cl.
CPC ..... *E05B 47/0046* (2013.01)

(58) Field of Classification Search
CPC ..... E05B 47/0046; E05B 15/02; E05B 73/00; E05B 15/00
See application file for complete search history.

(56) References Cited

U.S. PATENT DOCUMENTS 8,454,063 B2 * 6/2013 David ..... E05B 47/0046 292/341.15
2016/0053511 A1 * 2/2016 Peabody ..... E05B 47/0046 292/341.15

* cited by examiner

*Primary Examiner* — Kristina R Fulton
*Assistant Examiner* — Thomas L Neubauer
(74) *Attorney, Agent, or Firm* — Rosenberg, Klein & Lee

(57) ABSTRACT

An improved mechanism of electric lock for door, comprising a case, on both side of the opening of the case arranged keeper arms, drive rods, and rotate member, and a drive mechanism connected to a drive member and a brake member; to achieve lock mode, the drive member drive the brake member to be engaged with the rotate member, making the keeper arms and drive rod unable to rotate, so the keeper arms can block the latch bolt from going through the opening; to achieve unlock mode, the drive member drive the brake member to be separate from the rotate member, making the keeper arms and drive rod able to rotate, so the latch bolt is able to go through the opening.

7 Claims, 8 Drawing Sheets

MECHANISM OF ELECTRIC LOCK FOR DOOR

BACKGROUND OF THE INVENTION

1. Field of the Invention

The invention relates to a lock structure, especially to an electric lock for door that has a drive mechanism for controlling lock mechanism.

2. Description of the Related Art

The conventional electric lock for door usually has a case with a containing space for containing a latch bolt, and has a keeper arm connected to a drive mechanism for controlling the opening of the keeper arm; when the electric lock is going to be locked, the drive mechanism controls the keeper arm for limiting the latch bolt in the frame; when the electric lock is going to be unlocked, the drive mechanism controls the keeper arm for letting the latch bolt escape the frame.

FIG. 1 illustrated a door opener U.S. Pat. No. 6,390,520, an electric door opening mechanism, as showed in FIG. 1, the electric door opening mechanism comprising: a housing 910 having an opening 911 adapted to receive a bolt of a door, the mechanism has a least a keeper arms 920 and a drive rod 930, and using a magnetic coil 940 control a release lever 950 to switch the engaging mode of drive rod 930; when the mechanism is in the lock mode, the release lever 950 will engages the drive rod 930 and stops the pivot, in order to limit the keeper arms 920 inside the housing 910; when the mechanism is in the unlock mode, the release lever 950 will be separated from the drive rod 930 for making it be able to pivot, and further release the blocking of the keeper arms 920 and make it able to leave the housing 910.

In the above mentioned patent, the release lever 950 has a slot 951 and a through hole 952, the drive rod 930 has a t-shaped key 931 and a base 932, when the tail end of the release lever 950 is above the tail end of the drive rod 930, as FIG. 2A showing, the release lever 950 make the drive rod 930 to be in separate mode, and the drive rod 930 can be drive by keeper arms 920 and pivot, so as to achieve unlock mode; when the slot 951 of the release lever 950 is in the key portion 931 of the drive rod 930, as FIG. 2B showing, the release lever 950 and the drive rod 930 are in engage mode, and the keeper arms 920 cannot be pivot, so as to achieve lock mode;

when the slot 951 of the release lever 950 is through the base 932 of the drive rod 930, as FIG. 2C showing, the base 932 can go through the through hole 952, and the release lever 950 and the drive rod 930 are in separate mode, and the keeper arms 920 cannot be pivot, so as to achieve lock mode, the drive rod 930 can be drive by keeper arms 920 and pivot, so as to achieve unlock mode; however, the mechanism use the magnetic force of the magnetic coil 940 and the return of the spring 960 to control the release rod 950 pivot position as FIG. 1 showing, once the magnetic coil 940 and the spring 960 fatigue after frequent used, the release rod 950 may not be positioned accurately, and result in the release lever 950 separate from the drive rod 930 and fail to being locked, or the release lever 950 may be stuck with the drive rod 930 and fail to being unlocked; Since the tail end of the release lever 950 and the drive rod 930 may fail accurately control the release rod 950 and fail to finish lock or unlock action, so this invention has the problems of lack of stability and malfunction.

Moreover, the keeper arms 920 of the conventional door clock usually stuck while encounter preload, such as the door is deformed or being blow by strong wind; therefore, above conventional electronic locks need to be improved.

SUMMARY OF THE INVENTION

It is a primary objective of the present invention to provide an electric lock for door which having simple structure, low malfunction rate, low power consumption and can work accurately.

It is another objective of the present invention to provide an electric lock for door which having an energized door opening mode and power off door opening mode.

It is another objective of the present invention to provide an electric lock for door which can work normally under preload.

In order to achieve the above objectives, the present invention comprise: a case having a containing space for containing a latch bolt, and the side of the case has an opening for the latch bolt to go through; two keeper arms, two drive rods and two rotate members are linked together and symmetrically pivoted to the both side of the opening; two keeper arms symmetrically pivoted to the both side of the containing space, the two ends of the pivot hole of the keeper arms have blocking members and swing rods, the blocking members can block the latch bolt from going through the opening, and the bottom edge of the pivot hole arranged a torsional spring, when the keeper arms are drove to rotate, the torsional spring can let the keeper arms return; the two drive rods symmetrically pivoted to the rear end of the keeper arms and having a U shape positioning slot and a push rod on both ends, and let the swing rod of the keeper arms engage with the U shape positioning slot of the drive rod to make the drive rod be drove by the keeper arms and rotate; the two rotate members symmetrically arranged at the rear end of the drive rod, the rotate members have a first gap and a second gap on the outer periphery, and let the push rod of the drive rod engaged with the first gap of the rotate member to make the rotate member be drove by drive rod and rotate; two brake members symmetrically pivoted to the lateral side of the rotate members, the brake members have a first arm and a second arm arranged with 180° on the outer periphery and a blocking rod, and let the blocking rod of the brake members engaged with the second gap of the rotate members for stopping the rotation of the rotate members; two drive mechanisms symmetrically set at the lateral side of the brake members, having a shaft rod with the features of pop out and retract; and two drive members set on the tail end of the shaft rod, having a drive slot for engaging the first arm and the second arm of the brake members, so during the axially displacement of the drive members, the drive slot will drive the brake members to rotate.

Also, the present invention has an energized door opening mode, wherein the drive slot of the drive mechanism is engaged with the first arm of the brake members, the blocking rod of the brake members is engaged with the second gap of the rotate members for stopping the rotation of the rotate members, and further make the opening to be in locked mode; when the drive mechanism is energized and actuated, the axial displacement of the drive member will cause the blocking rod of the brake members to escape from the second gap of the rotate members, and the keeper arms and the drive rod will be able to rotate because the rotate members are not being blocked, and further make the opening to be in unlocked mode.

Also, the present invention has a power off door opening mode, wherein the drive slot of the drive mechanism is engaged with the second arm of the brake members, when the drive mechanism is energized and actuated, the axial displacement of the drive member will cause the blocking rod of the brake members to engage to the second gap of the rotate members, and the keeper arms and the drive rod will not be able to rotate because the rotate members are being blocked, and further make the opening to be in unlocked mode.

Also, the drive mechanism of the present invention is a solenoid valve, when the solenoid valve is energized and actuated, the shaft rod will be popped out; when the power of the solenoid valve is cut off, the shaft rod will be retracted.

Also, there is interval between the drive slot of the drive mechanism and the first and second arms of the brake members, the interval will provide the force that the drive member applied to the brake members during unlocked mode, and further make the blocking rod of the brake members escape rapidly from the second gap of the rotate members; during the locked mode, the interval will delay the drive member from pulling the brake members, and further make the blocking rod of the brake members engaged accurately with the second gap of the rotate members.

Also, the width of the U shape positioning slot is larger than the width of the outer end of the swing rod, so the outer end of the swing rod can have a rotation space inside the U shape positioning slot.

Also, the keeper arms, the drive rod, the rotate member, the brake member, the drive mechanism, and the drive member are symmetrically arranged, but the arrangement is not limited to such application.

With the feature disclosed above the present invention has below effects:

1. The push rod of the drive rod is several times longer than the positioning slot, when the drive rod is rotated, since the force is inversely proportional to length when the torque is the same, the applied force at the push rod ends is smaller than the applied force at the positioning slot; therefore, the solenoid valve can let the drive member displace axially with only very small power consumption, and further achieve unlock and lock the door rapidly, so as to having the advantage of stability.

2. The present invention uses the linkage of the keeper arms, the drive rod and the rotate member to drive the brake member to engage the rotate member by the drive member to stop the rotation, so the keeper arms and the drive rod will not be able to rotated to achieve lock mode; the drive member drive the brake member to make the rotate member leave the engagement, so the keeper arms and the drive rod are able to pivot to achieve unlock mode; therefore, the present invention has the features of simple structure and reliability.

3. The width of the U shape positioning slot is wider than the width of the outer end of the swing rod to make the outer end of the swing rod have a rotation space inside the U shape positioning slot for avoid the influence of a preload on the blocking member, when the door is deformed or under wind pressure, the door can still be opened normally.

4. There is interval between the drive slot of the drive mechanism and the first and second arms of the brake members, and make the blocking rod of the brake members escape rapidly from engagement of the rotate members; also, the interval will delay the drive member from pulling the brake members, and further make the blocking rod of the brake members engaged accurately with the rotate members.

5. By changing the arrangement angle of the drive member, the present invention can let the electric door lock having: energized door opening mode which means the drive mechanism is locked and constantly not energized, and when the drive mechanism is energized and active, the door lock will be unlocked; power off door opening mode which means the drive mechanism is locked and constantly energized, and after cutting the power off, the door lock will be unlocked.

DETAILED DESCRIPTION OF THE PREFERRED EMBODIMENT

Figure 1:
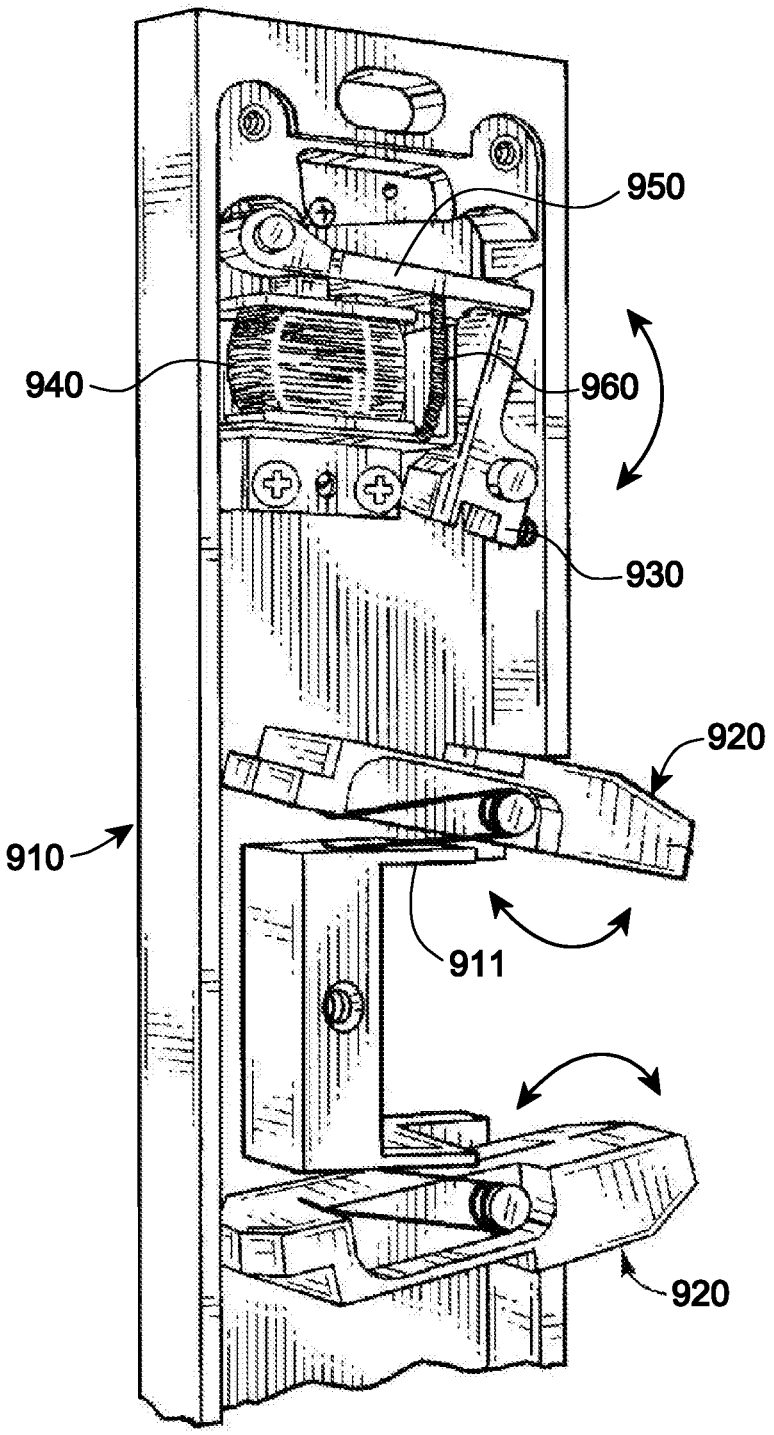
FIG.1 PRIOR ART
FIG. 1 is a schematic diagram illustrating structure of the electric lock according to the prior art.
Figure 2A:
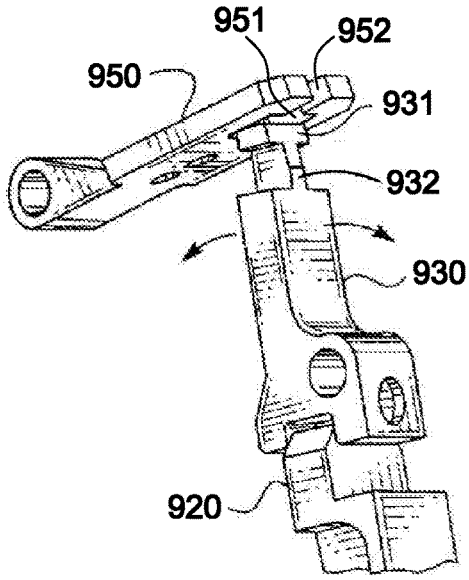
FIG.2A PRIOR ART
FIG. 2A is a schematic diagram illustrating unlocked situation under safe mode of the electric lock according to the prior art.
Figure 2B:
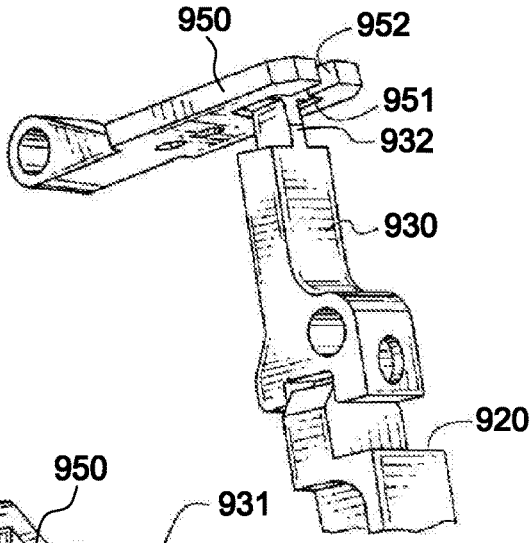
FIG.2B PRIOR ART
FIG. 2B is a schematic diagram illustrating locked situation of the conventional electric lock.
Figure 2C:
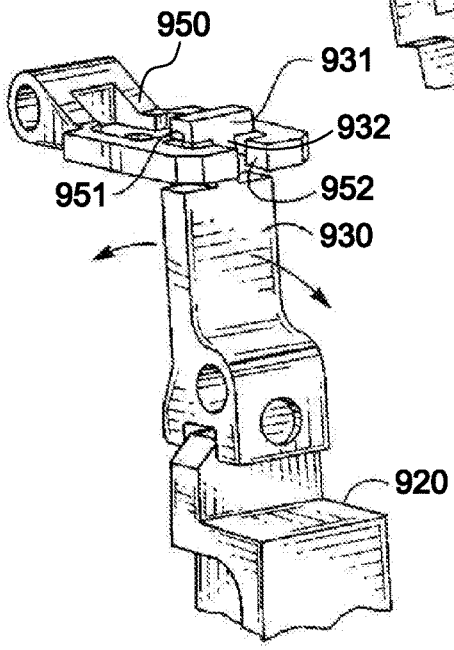
FIG.2C PRIOR ART
FIG. 2C is a schematic diagram illustrating unlocked situation under security mode of the electric lock according to the prior art.
Figure 3:
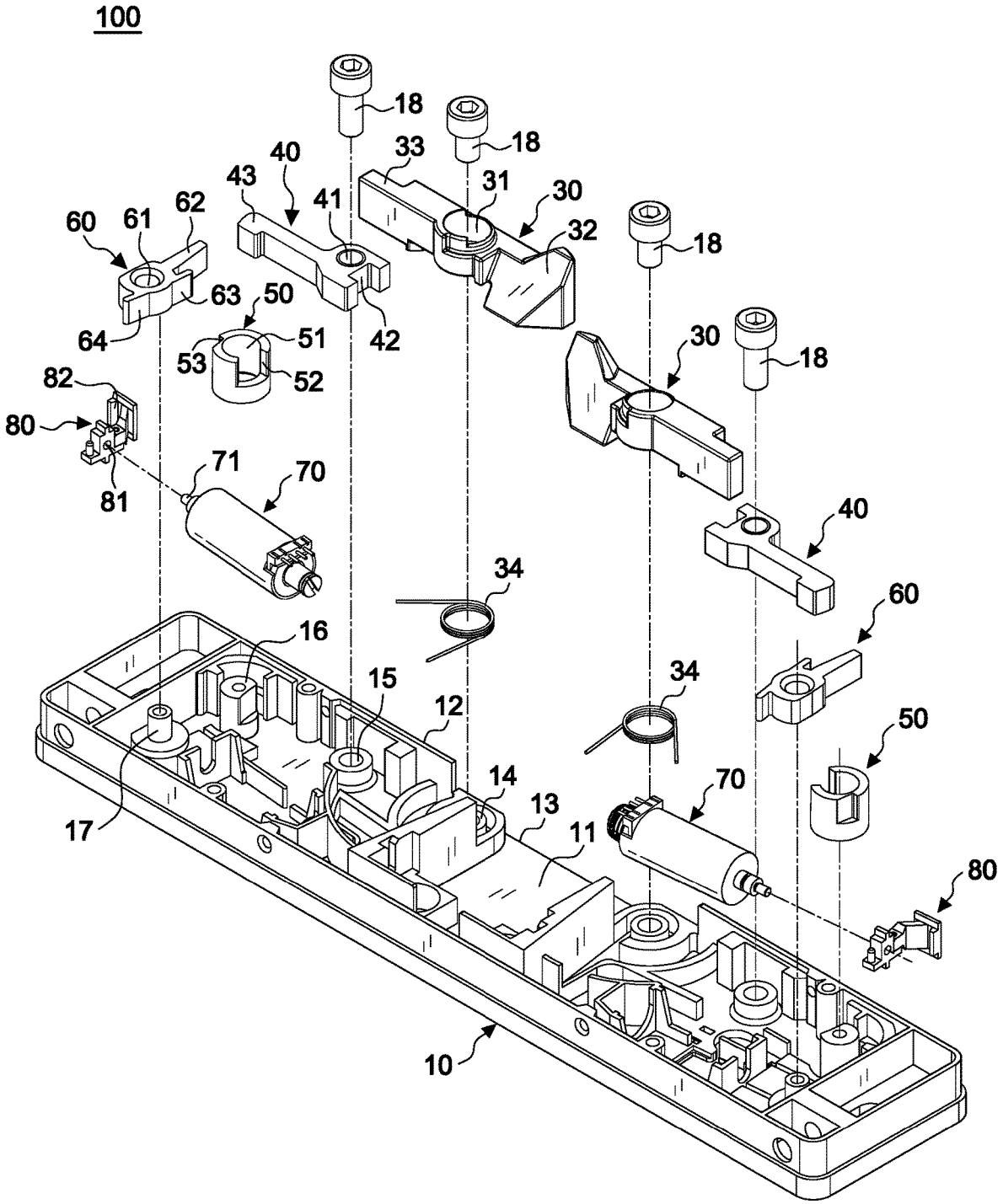
FIG. 3 is an exploded perspective views of the present invention.
Figure 4:
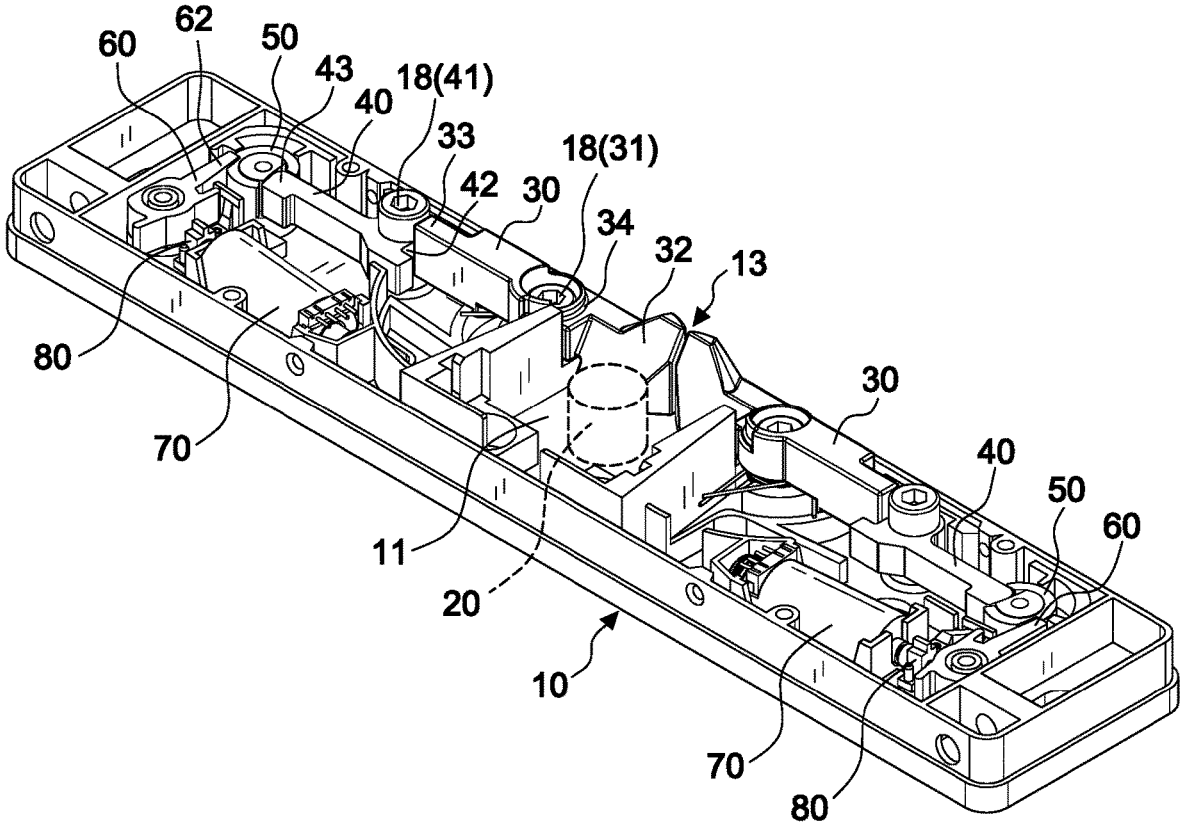
FIG. 4 is an assembly perspective views of the present invention.

Referring to FIGS. 3-4, the improved mechanism of electric lock for door 100, including: a case 10 having a containing space 11 for containing a latch bolt 20, as FIG. 4 showing, and the side of the case 12 has an opening 13 for the latch bolt 20 to go through, and the both side of the opening 13 are symmetrically arranged with a first positioning block 14, a second positioning block 15, a first pivot block 16, and a second pivot block 17.

Two keeper arms 30, each of them having a first pivot hole 31, and being pivoted by a pivot pin 18 on the first positioning block 14, the both side of the first pivot hole 31 have blocking members 32 and swing rods 33, the blocking members 32 can block the latch bolt 20 from going through the opening 13, and the pivot pin 18 of the bottom edge of the first pivot hole 31 arranged a torsional spring 34, and one side of the torsional spring 34 is connected to the keeper arms and the other side is connected to the case 10, when the keeper arms 30 are drove to rotate, the torsional spring 34 can let the keeper arms 30 return.

Two drive rod 40, each of them having a second pivot hole 41, and being pivoted by a pivot pin 18 on the second positioning block 15, the both side of the second pivot hole 41 have a U shape positioning slot 42 and a push rod 43, and let the swing rod 33 of the keeper arms 30 engage with the U shape positioning slot 42 to make the drive rod 40 be drove by the keeper arms 30 and rotate; in this embodiment, referring to FIG. 5, the width of the U shape positioning slot 42 is wider than the width of the outer end of the swing rod 33 to make the outer end of the swing rod 33 have a rotation space S inside the U shape positioning slot 42 for avoid the influence of a preload P on the blocking member 32, when the door is deformed or under wind pressure, the door can still be opened normally.

Two rotate members 50, each of them having a third pivot hole 51 arranged on the first pivot block 16, the rotate members 50 have a first gap 52 and a second gap 53 on the outer periphery, and let the push rod 43 of the drive rod 40 engaged with the first gap 52 of the rotate member 50 to make the rotate member 50 be drove by drive rod 40 and rotate.

Two brake members 60, each of them having a fourth pivot hole 61 arranged on the second pivot block 17, the outer periphery of the brake members 60 have a blocking rod 62 and a first arm 63 and a second arm 64 arranged with 180°, and let the blocking rod 62 of the brake members 60 engaged with the second gap 53 of the rotate members 50 for stopping the rotation of the rotate members 50.

Two drive mechanisms 70 set inside the case 10 of the brake members 60, having a shaft rod 71 with the features of pop out and retract.

Two drive members 80 having shaft holes 81 set on the tail end of the shaft rod 71, having a drive slot 82 for engaging the first arm 63 and the second arm 64 of the brake members 60, so during the axially displacement of the drive members 80, the drive slot 82 will drive the brake members 60 to rotate; wherein the drive mechanism 70 is a solenoid valve 70, when the solenoid valve 70 is energized and actuated, the shaft rod 71 actuated will be popped out; when the power of the solenoid valve 70 is cut off, the shaft rod 71 will be retracted.

In present invention, one end of the second pivot hole 41 of the drive rod 40 has a U shape positioning slot 42 and the other end has a push rod 43, referring to FIG. 3-4, the push rod 43 is several times longer than the U shape positioning slot 42, when the drive rod 40 is rotated, since the force is inversely proportional to length when the torque is the same, the applied force at the push rod 43 ends is smaller than the applied force at the U shape positioning slot 42; the keeper arms 30 is rotated by the linkage of the drive rod 40 and the rotate member 50, and the active force of the push rod 43 is applied on the first gap 52, the blocking rod 62 of the brake members 60 is engaged on the second gap 53, therefore the engagement force of the blocking rod 62 will be smaller than active force of the blocking member 32 of the keeper arms 30; moreover, the rotation of the brake member 60 is rely on the axially displacement of the drive member 80, evidently, with just a small push force applied on the drive member 80 can overcome the engagement force of the blocking rod 62 and drive the brake members 60 to rotate, further let the rotate member 50 leave the blocking and achieve the effect of unlocking the keeper arms 30; therefore, the linkage of the keeper arms 30, the drive rod 40 and the rotate member 50 and the characteristic that the drive rod 40 is several times longer than the push rod 43 let the solenoid valve 70 able to drive the drive member 80 to do axial displacement with o only very small power consumption, and further achieve unlock and lock the door rapidly, so as to having the advantage of stability.

Another feature of the present invention is that the drive slot of the drive mechanism is thicker than the first arm 63 and second arm 64 of the brake members 60, which means there is interval between the drive slot 82 of the drive mechanism 80 and the first arm 63 and second arm 64, the interval forms an impulsive force that the drive mechanism 80 apply to the brake members 60 during unlock mode, and make the blocking rod 62 of the brake members 60 escape rapidly from engagement of the second gap of the rotate members 50; also, the interval will delay the drive member 80 from pulling the brake members 60, and further make the blocking rod 62 of the brake members 60 engaged accurately with the second gap 53 of the rotate members 50.

Figure 5A:
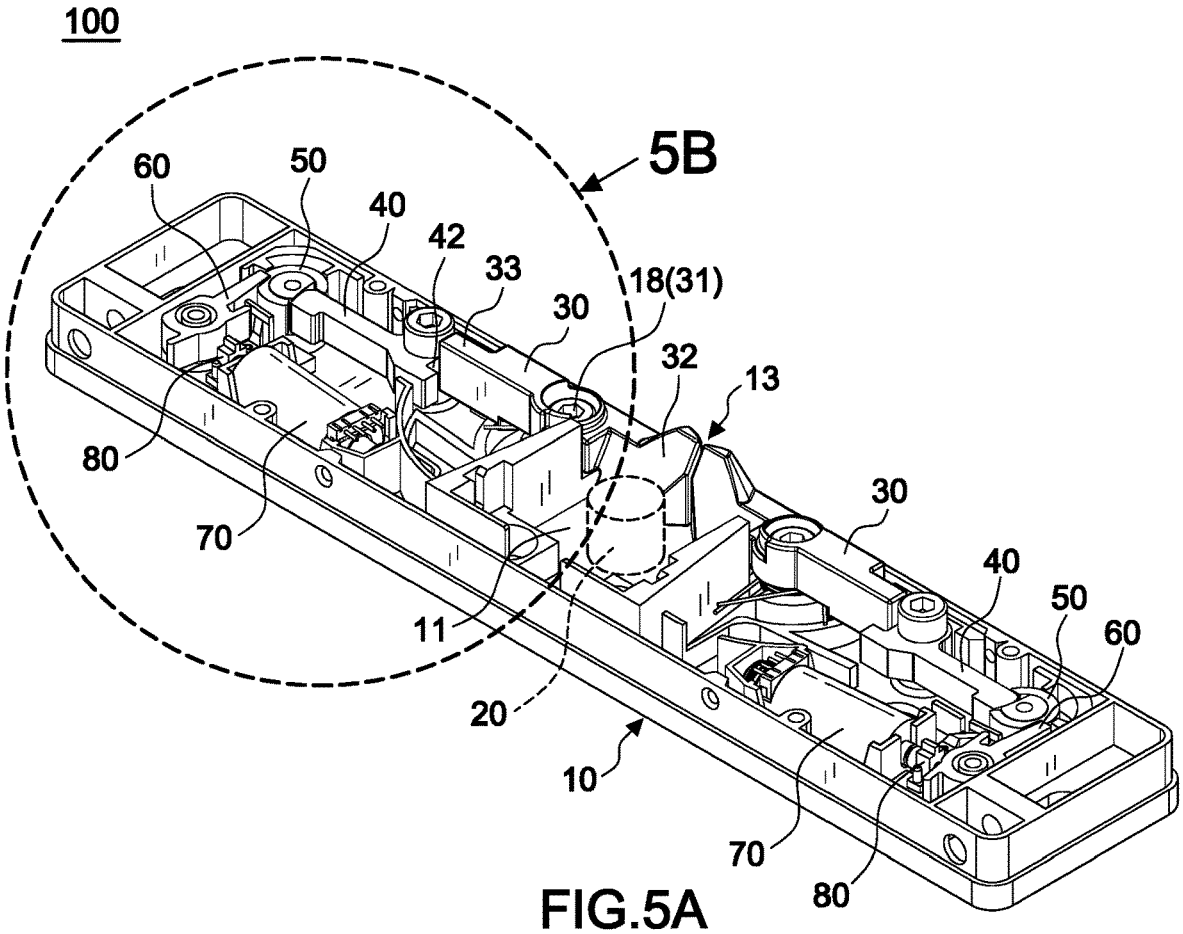
FIG. 5A is an assembly perspective views of the energized door opening mode of the present invention.
Figure 5B:
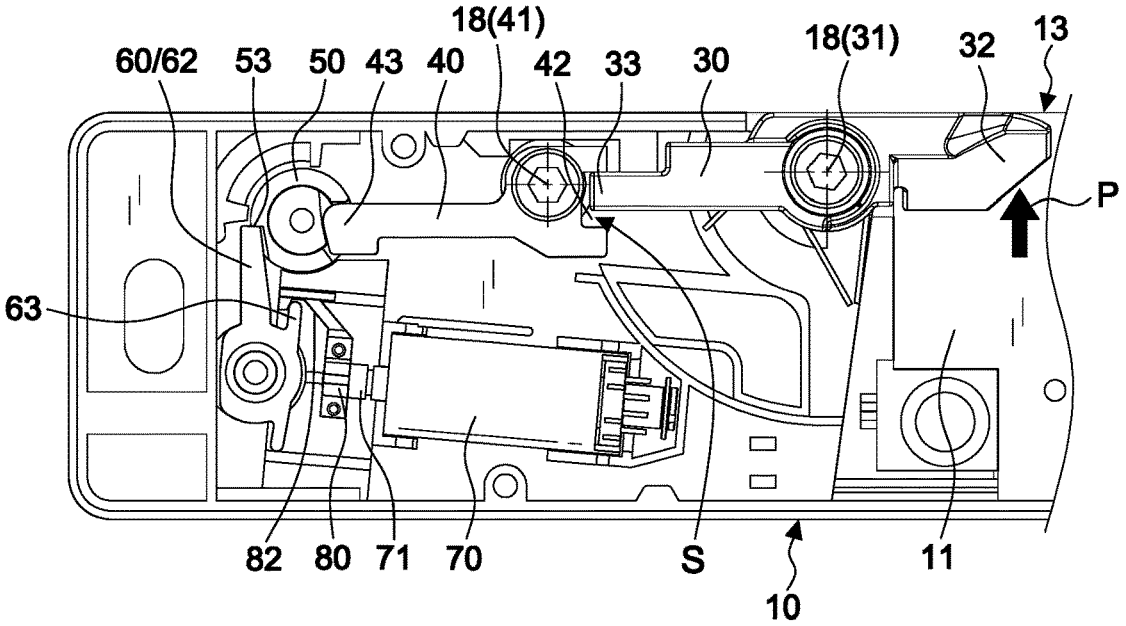
FIG. 5B is a schematic diagram illustrating the locked situation of the energized door opening mode of the present invention.
Figure 5C:
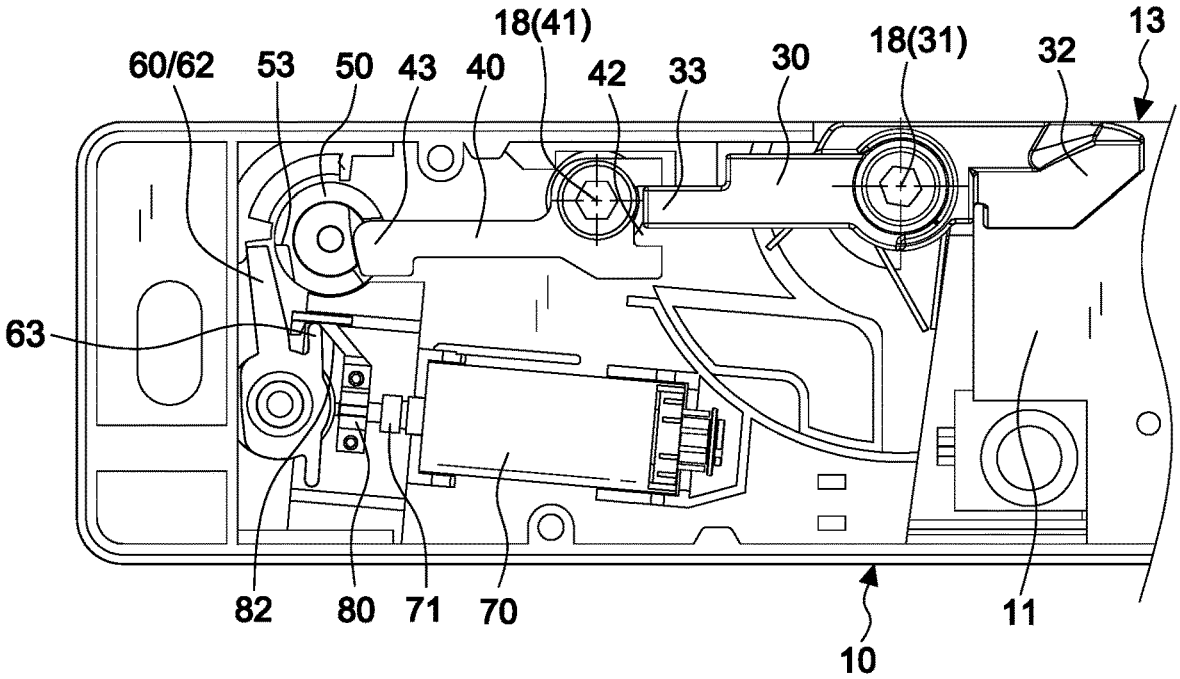
FIG. 5C is a schematic diagram illustrating the unlocked situation of the energized door opening mode of the present invention.
Figure 5D:
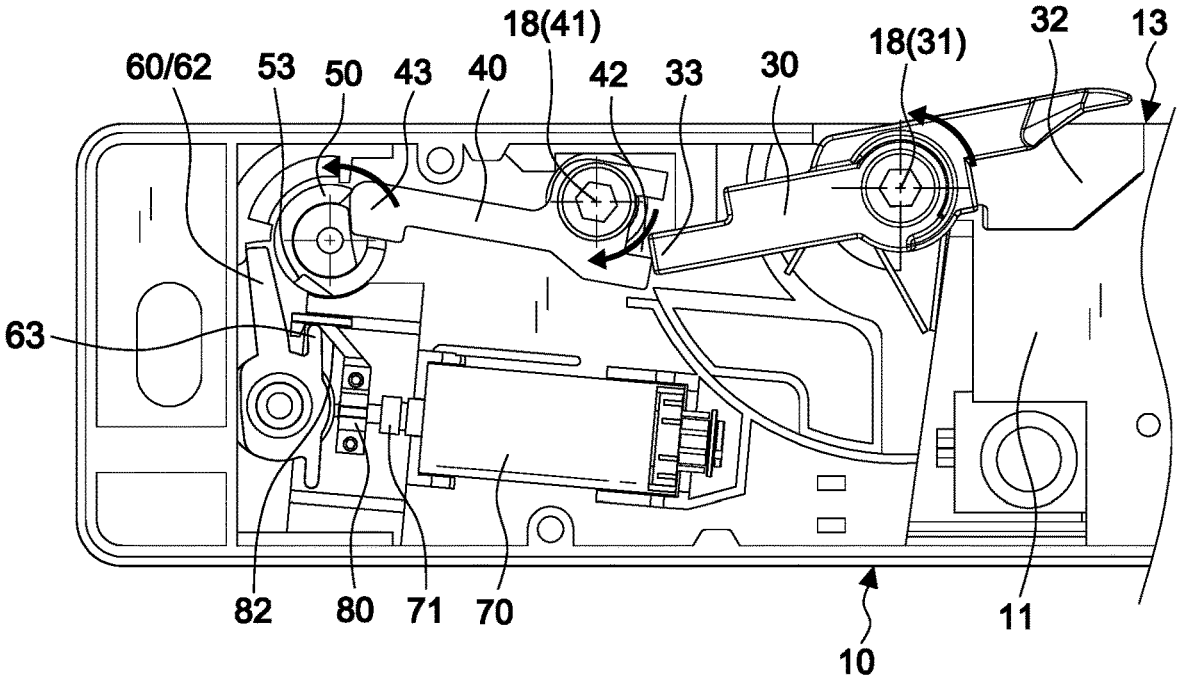
FIG. 5D is a schematic diagram illustrating the unlocked action of the energized door opening mode of the present invention.

By changing the arrangement angle of the drive member 80, the present invention can have two working mode, wherein an energized door opening mode which means the drive mechanism 70 is locked and constantly not energized, and when the drive mechanism 70 is energized and active, the door lock will be unlocked, the structure of the mechanism is showed in FIGS. 5A-5D; As FIG. 5B showing; Referring to FIG. 5B, the shaft rod 71 is retracted, the drive slot 82 of the drive member 80 that connected the shaft rod 71 is arranged toward the opening 13 of the case 10, and the drive slot 82 is engaged with the first arm 63 of the brake member 60, also, the blocking rod 62 of the brake member 60 is engaged with the second gap 53 of rotate member 50, and make the rotate member 50 to be block and unable to rotate; Since the keeper arms 30, the drive rod 40 and the rotate member 50 are linked together, the keeper arms 30 is unable to rotate, the latch bolt inside the containing space 11 of the case 10 is unable to go through the opening 13, further make the opening 13 to be lock mode; Referring to SC, when the drive mechanism 70 is energized and actuated, the shaft rod 71 is popped out, the drive slot 82 of the drive member 80 will push the first arm 63 of the brake member 60 to rotate counterclockwise, meanwhile, the blocking rod 62 of the brake member 60 is separated from the second gap 53 of rotate member 50, and make the rotate member 50 be able to rotate, since the keeper arms 30, the drive rod 40 and the rotate member 50 are linked together, the keeper arms 30 is able to rotate, the latch bolt inside the containing space 11 of the case 10 is able to go through the opening 13, further make the opening 13 to be unlock mode; FIG. 5D is a schematic diagram illustrating the unlocked status of how the latch bolt go through opening 13 and make the blocking member 32 of the keeper arms 30 opened.

Figure 6A:
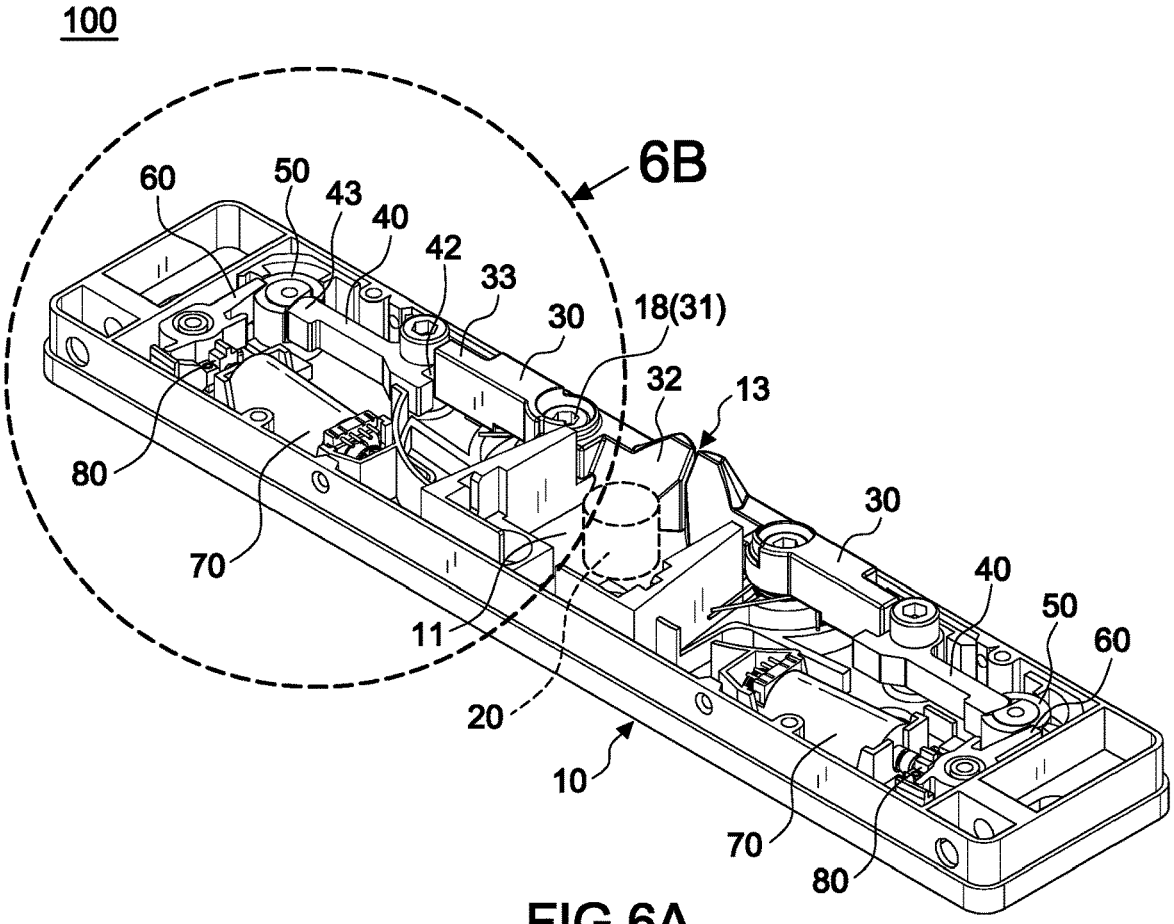
FIG. 6A is an assembly perspective views of the energized door closing mode of the present invention.
Figure 6B:
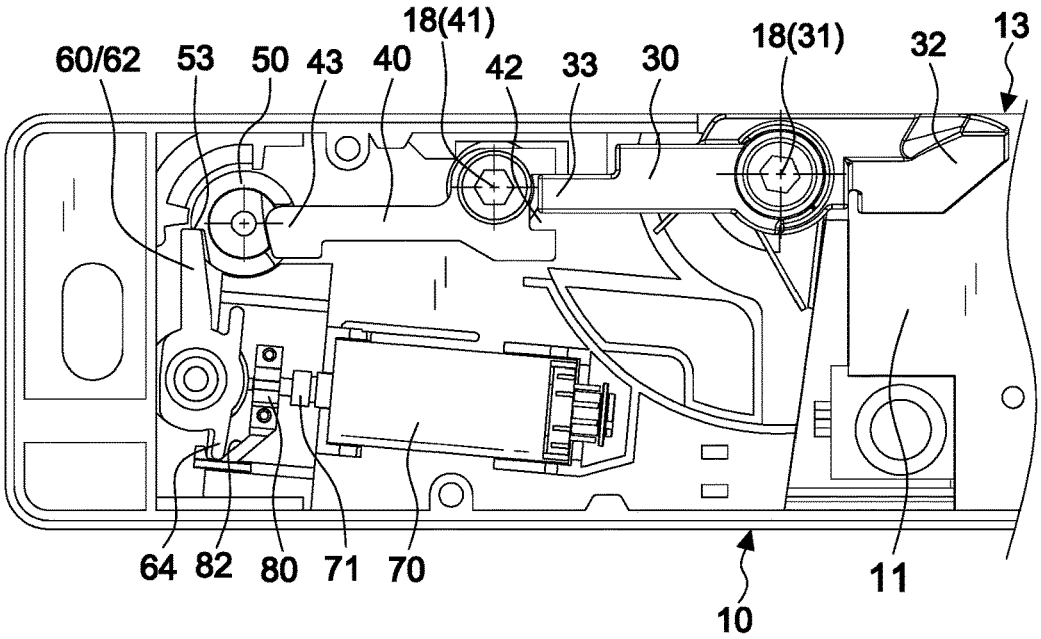
FIG. 6B is a schematic diagram illustrating the locked situation of the energized door closing mode of the present invention.
Figure 6C:
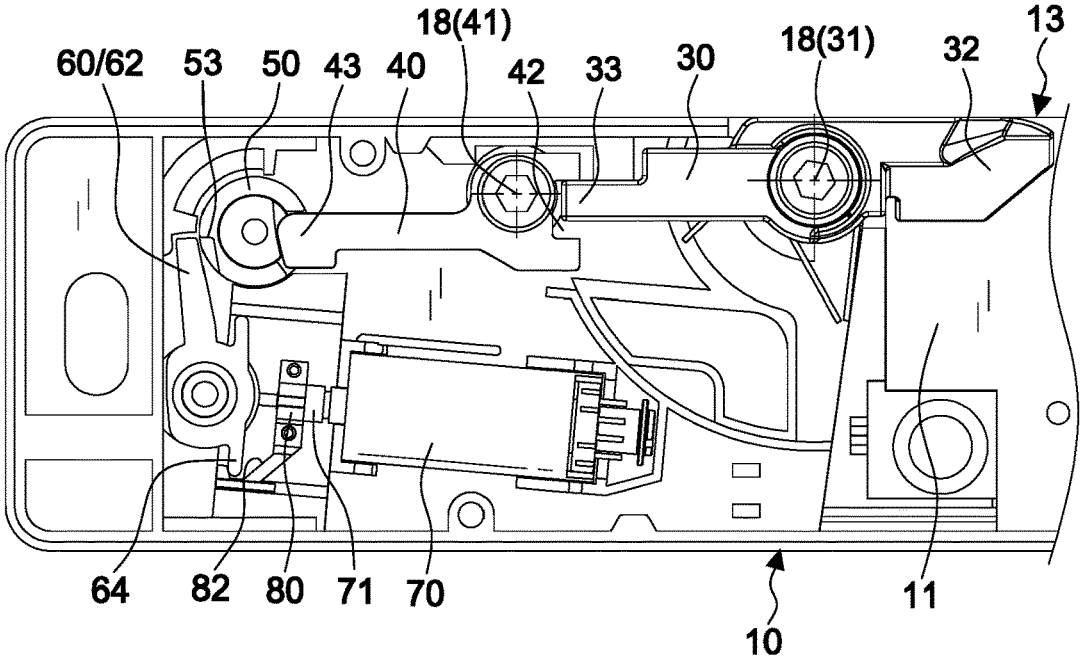
FIG. 6C is a schematic diagram illustrating the unlocked situation of the energized door closing mode of the present invention.
Figure 6D:
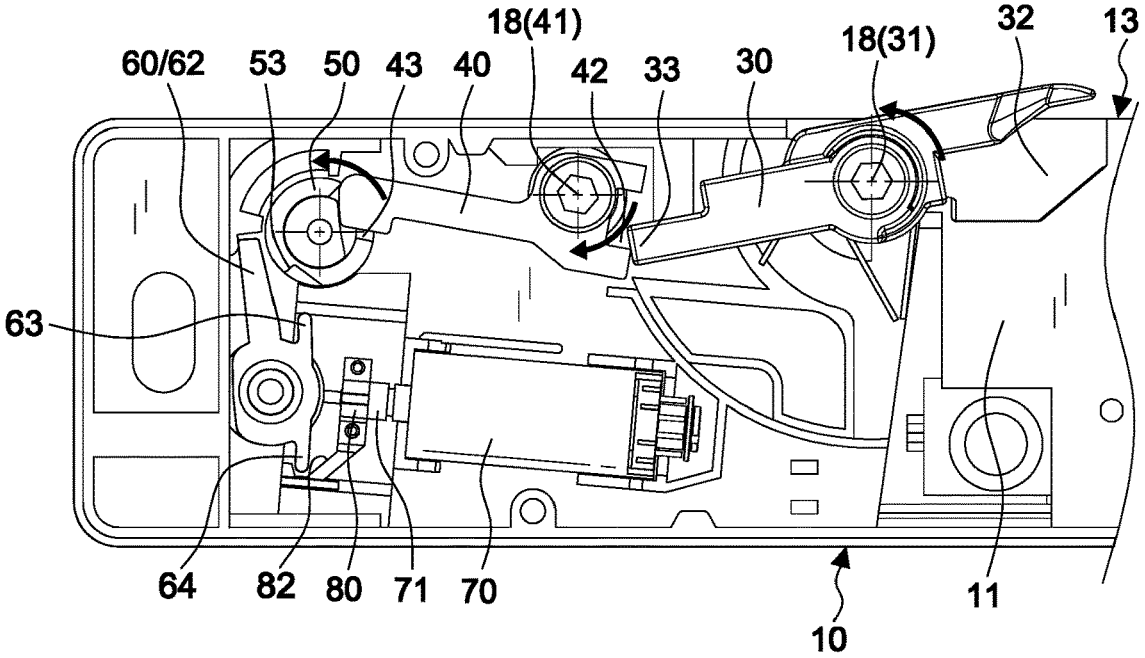
FIG. 6D is a schematic diagram illustrating the unlocked action of the energized door closing mode of the present invention.

The power off door opening mode of the present invention means when the door is locked, the lock is constantly energized, and by the external control system can cut off the power of the lock and further unlocked the door; that is when the drive mechanism 70 is locked and constantly energized, and after cutting the power off the door lock will be unlocked, as FIGS. 6A-6D showing; As FIG. 6B showing, the drive slot 82 of the drive member 80 that connected the shaft rod 71 is arranged toward the opening 13 of the case 10, the drive mechanism 70 is energized and actuated, the shaft rod 71 is popped out, the drive slot 82 of the drive member 80 will push the second arm 64 of the brake member 60 to rotate clockwise, meanwhile, the blocking rod 62 of the brake member 60 is engaged with the second gap 53 of rotate member 50, and make the rotate member 50 be unable to rotate, since the keeper arms 30, the drive rod 40 and the rotate member 50 are linked together, the keeper arms 30 is unable to rotate, the latch bolt inside the containing space 11 of the case 10 is unable to go through the opening 13, further make the opening 13 to be lock mode; Referring to 6C, when the drive mechanism 70 is energized and actuated, the shaft rod 71 is retracted, the drive slot 82 of the drive member 80 will pull the second arm 64 of the brake member 60 to rotate counterclockwise, meanwhile, the blocking rod 62 of the brake member 60 is separated from the second gap 53 of rotate member 50, and make the rotate member 50 be able to rotate, since the keeper arms 30, the drive rod 40 and the rotate member 50 are linked together, the keeper arms 30 is able to rotate, the latch bolt inside the containing space 11 of the case 10 is able to go through the opening 13, further make the opening 13 to be unlock mode; FIG. 6D is a schematic diagram illustrating the unlocked status of how the latch bolt go through opening 13 and make the blocking member 32 of the keeper arms 30 opened.

Also, in the above mentioned embodiment, the keeper arms 30, the drive rod 40, the rotate-member 50, the brake member 60, the drive mechanism 70, and the drive member 80 are not limited to be arranged symmetrically two by two. In fact, the present invention can work functionally with only one keeper arms 30, one drive rod 40, one rotate member 50, one brake member 60, one drive mechanism 70, and one drive member 80, and the operation mode and principle are exactly the same as the two symmetrical configurations.

First, since the push rod 43 of the drive rod 40 is several times longer than the positioning slot 42, when the drive rod 40 is rotated, since the force is inversely proportional to length when the torque is the same, the applied force at the push rod 43 ends is smaller than the applied force at the positioning slot 42; therefore, the solenoid valve 70 can let the drive member 80 displace axially with only very small power consumption, and further achieve unlock and lock the door rapidly, so as to having the advantage of stability. Second, the present invention uses the linkage of the keeper arms 30, the drive rod 40 and the rotate member 50 to drive the brake member 60 to engage the rotate member 50 by the drive member 80 to stop the rotation, so the keeper arms 30 and the drive rod 40 will not be able to rotated to achieve lock mode; the drive member 80 drive the brake member 60 to make the rotate member 50 leave the engagement, so the keeper arms 30 and the drive rod 40 are able to pivot to achieve unlock mode; therefore, the present invention has the features of simple structure and reliability. Third, the width of the U shape positioning slot 42 is wider than the width of the outer end of the swing rod 33 to make the outer end of the swing rod 33 have a rotation space S inside the U shape positioning slot 42 for avoid the influence of a preload P on the blocking member 32, when the door is deformed or under wind pressure, the door can still be opened normally.

Fourth, there is interval between the drive slot 82 of the drive mechanism 80 and the first and second arms 63/64 of the brake members 60, and make the blocking rod 62 of the brake members 60 escape rapidly from engagement of the rotate members 50 also, the interval will delay the drive member 80 from pulling the brake members 60, and further make the blocking rod 62 of the brake members 60 engaged accurately with the rotate members 50.

Finally, By changing the arrangement angle of the drive member 80, the present invention can let the electric door lock having: energized door opening mode which means the drive mechanism 70 is locked and constantly not energized, and when the drive mechanism 70 is energized and active, the door lock will be unlocked; power off door opening mode which means the drive mechanism 70 is locked and constantly energized, and after cutting the power off, the door lock will be unlocked.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An improved mechanism of an electric lock for a door, comprising:

a case having a containing space for containing a latch bolt, and a side of the case has an opening for receiving the latch bolt;

two keeper arms each pivoted to opposing sides of the containing space, each of the two keeper arms have a blocking member and a swing rod on respective opposing ends thereof, a pivot hole is formed in each keeper arm between the corresponding blocking member and the corresponding swing rod, each blocking member selectively blocks the latch bolt from being received through the opening, and a respective torsional spring is disposed at a bottom edge of the pivot hole of each of the keeper arms, and responsive to the keeper arms being rotatably driven, the torsional springs respectively resiliently oppositely bias the keeper arms;

two drive rods each being pivoted to the adjacent respective swing rod of a corresponding one of the keeper arms, and each drive rod having a U shape positioning slot and a push rod on opposing ends thereof, and the swing rod of a corresponding keeper arm engages with the U shape positioning slot of the corresponding drive rod, thereby the drive rod rotatably drives the corresponding keeper arm;

two rotate members each respectively arranged adjacent the push rod of a corresponding one of the two drive rods, each of the two rotate members being formed with a first gap and a second gap on a respective outer periphery thereof, and the push rod of each of the two drive rods being engaged with the first gap of a corresponding rotate member, thereby each rotate member rotatably drives the corresponding drive rod;

two brake members each respectively pivoted adjacent to respective lateral sides of the two rotate members, each of the two brake members have a first arm and a second arm arranged at substantially 180° relative to one another and on an outer periphery of the corresponding brake member, and each of the two brake members also have a blocking rod selectively engaged with the second gap of the corresponding rotate member for either allowing or stopping rotation of the rotate member;

two drive mechanisms each respectively set at a lateral side of a corresponding one of the two brake members, and each of the two drive mechanisms have a shaft rod configured to either extend or retract; and two drive members each respectively set on a tail end of the shaft rod of a corresponding one of the two drive mechanisms, and each of the two drive members have a drive slot for engaging with either one of the first arm or the second arm of the corresponding brake member, whereby selective engagement between the shaft rod of the drive mechanism and the first and second arms of the corresponding brake member rotatably drives the blocking rod of the brake member to be either engaged or disengaged with the second gap of the corresponding rotate member.

2. The improved mechanism of an electric lock for a door as claimed in claim 1, wherein in an energized door opening mode, the drive slot of the respective drive member is engaged with the first arm of the corresponding brake member, thereby the blocking rod of the corresponding brake member is engaged with the second gap of the corresponding rotate member for stopping the rotation of the rotate member, and the opening of the case is thereby in a locked mode; and responsive to the respective drive mechanism being energized and actuated, the corresponding drive member is axially displaced to thereby drive the blocking rod of the corresponding brake member to disengage from the second gap of the corresponding rotate member, thereby the keeper arms and the drive rods are rotatably driven responsive to the rotate members not being blocked from rotation, and the opening of the case is thereby in an unlocked mode.

3. The improved mechanism of an electric lock for a door as claimed in claim 1, wherein in a power off door opening mode, the drive slot of the respective drive member is engaged with the second arm of the corresponding brake member, responsive to the respective drive mechanism being energized and actuated, the corresponding drive member is axially displaced to thereby drive the blocking rod of the corresponding brake member to engage with the second gap of the corresponding rotate member, and the keeper arms and the drive rods are not rotatably driven responsive to the rotate members being blocked from rotation, and the opening of the case is thereby in a locked mode.

4. The improved mechanism of an electric lock for a door as claimed in claim 1, wherein the two drive mechanisms include respective solenoid valves, when the solenoid valve of the drive mechanism is energized and actuated, the corresponding shaft rod is configured to extend; and when power of the solenoid valve of the drive mechanism is cut off, the corresponding shaft rod is configured to retract.

5. The improved mechanism of an electric lock for a door as claimed in claim 4, wherein an intervening space is formed between the drive slot of the drive member and the first and second arms of the corresponding brake member, the intervening space allowing for generation of a force for driving of the brake member by the corresponding drive member during an unlocked mode, and thereby drive the blocking rod of the corresponding brake member to disengage from the second gap of the corresponding rotate member; during a locked mode, the intervening space delays the drive member from pulling the corresponding brake member, and thereby drive the blocking rod of the corresponding brake member to remain engaged with the second gap of the corresponding rotate member.

6. The improved mechanism of an electric lock for a door as claimed in claim 1, wherein a width of the U shape positioning slot of the corresponding drive rod is larger than a width of an outer end of the corresponding swing rod, thereby a rotation space is formed within each of the two the U shape positioning slots for receiving the corresponding swing rod.

7. An improved mechanism of an electric lock for a door, comprising:

a case having a containing space for containing a latch bolt, and a side of the case has an opening for receiving the latch bolt;

a keeper arm pivoted to the containing space, two opposing ends of the keeper arm have a respective blocking member and a respective swing rod, the blocking member selectively blocks the latch bolt from being received through the opening, a pivot hole is formed in the keeper arm between the blocking member and the swing rod, and a torsional spring is disposed at a bottom edge of the pivot hole of the keeper arm, and responsive to the keeper arm being rotatably driven, the torsional spring resiliently oppositely biases the keeper arm;

a drive rod pivoted to the swing rod of the keeper arm, and the drive rod having a U shape positioning slot and a push rod on respective opposing ends thereof, and the swing rod of the keeper arm engages with the U shape positioning slot of the drive rod, thereby the drive rod rotatably drives the keeper arm;

a rotate member arranged at the push rod of the drive rod, the rotate member is formed with a first gap and a second gap on an outer periphery thereof, and the push rod of the drive rod is engaged with the first gap of the rotate member, thereby the rotate member rotatably drives the drive rod;

a brake member pivoted to a lateral side of the rotate member, the brake member has a first arm and a second arm arranged at substantially 180° relative to one another and on an outer periphery thereof, and the brake member also has a blocking rod selectively engaged with the second gap of the rotate member for either allowing or preventing rotation of the rotate member, wherein the blocking rod extends from the brake member to be formed with a length greater than respective lengths of the first arm and the second arm;

a drive mechanism set at a lateral side of the brake member, the drive mechanism having a shaft rod configured to either extend or retract; and a drive member set on a tail end of the shaft rod, the drive member having a drive slot for engaging with either one of the first arm or the second arm of the brake member, whereby selective engagement between the shaft rod and the first and second arms of the brake member rotatably drives the blocking rod to be either engaged or disengaged with the second gap of the rotate member.

* * * * *